United States Patent [19]

Katzman et al.

[11] Patent Number: 4,622,019

[45] Date of Patent: Nov. 11, 1986

[54] TOY FIGURINE AND ENVIRONMENT PLAYSET

[75] Inventors: Allison W. Katzman, Chicago; Donald A. Rosenwinkel; Wayne A. Kuna, both of Oak Park, all of Ill.

[73] Assignee: Marvin Glass & Associates, Chicago, Ill.

[21] Appl. No.: 782,595

[22] Filed: Sep. 27, 1985

Related U.S. Application Data

[63] Continuation of Ser. No. 575,870, Feb. 1, 1984, abandoned.

[51] Int. Cl.[4] ..... A63H 23/00

[52] U.S. Cl. ..... 446/153; 446/296; 446/268

[58] Field of Search ..... 446/153, 156, 158, 160, 446/161, 268, 296, 319, 325, 326, 396, 472, 491, 376, 383; 272/1 B

[56] References Cited

U.S. PATENT DOCUMENTS

| | | | |
|---|---|---|---|
| 1,399,855 | 12/1921 | Fierlein | 446/156 |
| 2,650,453 | 9/1953 | Martin | 446/156 |
| 3,740,894 | 6/1973 | Howland et al. | 446/383 |
| 4,246,719 | 1/1981 | Kulesza et al. | 446/153 X |
| 4,302,003 | 11/1981 | Hughes | 446/153 X |

*Primary Examiner*—Mickey Yu

*Attorney, Agent, or Firm*—John S. Pacocha

[57] ABSTRACT

A playset for use in and out of water includes a seahorse figurine with long rooted mane hair and a coral corral. The seahorse figurine has a relatively watertight upper body and a rotatably connected lower tail portion. A weight is positioned in the tail so that rotation of the tail orients the angular position of the figurine when it is floating in water. Vents are provided in the tail for displacement of air. The coral corral floates in the water with a substantial portion, including provisions for accessories for the care of the figurine, above the water level. Alternatively, the corral may be placed on a table or other flat surface when it also provides support for the seahorse figurine.

20 Claims, 6 Drawing Figures

TOY FIGURINE AND ENVIRONMENT PLAYSET

This is a continuation of co-pending application Ser. No. 575,870 filed Feb. 1, 1984, now abandoned.

BACKGROUND OF THE INVENTION

1. Field of the Invention

This invention relates generally to playsets for children that include a figurine, environment and accessories and more particularly to a playset that may be used both in and out of the water.

2. Background Art

Playsets involving characters or figurines with environments that are thematically related to the figurines are popular children's toys. Examples of such prior art playsets may be found in U.S. Pat. Nos. 4,030,234; 4,030,235; and 4,139,967. Some of the prior art playsets also provide accessories related to the environment and/or the figurine to increase the manipulative play provided by the toy. Baths often provide children with a time for play of the type to which the figurine-environment-accessory playset is particularly well adapted. There are a number of toy boats of various descriptions for such purposes. There remains a need, however, for a playset that will afford children an opportunity to use bath time for imaginative manipulative play with a toy figurine while providing in-water storage for accessories usable with the figurine and which also may be enjoyed by the child out of the water. Additionally, the child should be given some control over how a part of the playset floats in the water to stimulate the child's interest and provide some educational benefit.

SUMMARY OF THE INVENTION

The present invention is concerned with providing a child's figurine-environment-accessory playset which the child may enjoy in and out of the water. These and other objects and advantages of the invention are achieved by a playset including a seahorse figurine with long rooted mane hair and a coral corral with provisions for accessories for the care of the seahorse and its hair. The figurine has an upper body portion that is relatively watertight and a lower portion rotatably connected to the upper part. A weight and vents for the displacement of air from the lower portion control the buoyancy of the figurine in the water. Rotation of the lower tail portion relative to the upper body controls the angular orientation of the figurine while it is floating in water. The coral corral environment is constructed to float in the water with a substantial portion, including the provisions for the support of accessories, above the water. Alternatively, the corral may be placed upon a table or other relatively flat surface when the corral also provides support for the seahorse figurine.

BRIEF DESCRIPTION OF THE DRAWING

For a better understanding of the present invention reference may be had to the accompanying drawing in which.

DETAILED DESCRIPTION OF THE PREFERRED EMBODIMENT

Figure 1:
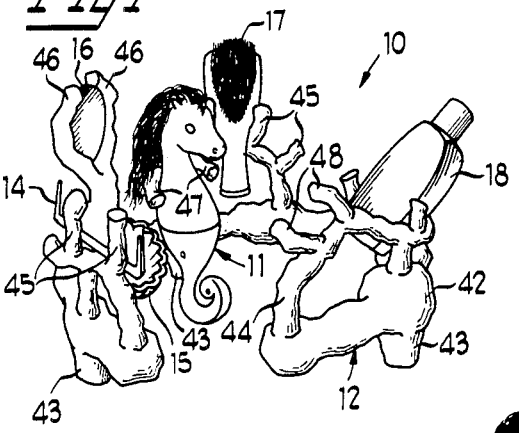
FIG. 1 is a perspective view of one embodiment of the present invention.
Figure 2:
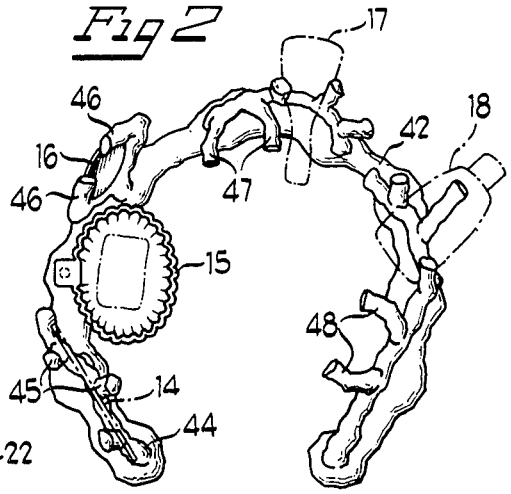
FIG. 2 is a top plan view.
Figure 3:
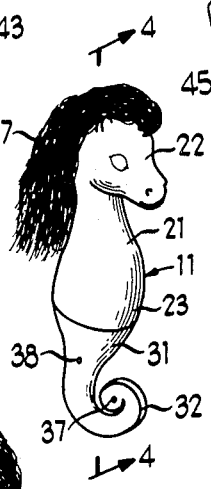
FIG. 3 is an enlarged scale, perspective view of the figurine.

Referring now to the drawing in which like parts are designated by like reference characters throughout the several views, there is shown in FIG. 1 as playset 10 that includes a seahorse figurine 11, a coral corral environment 12, comb 14, soap dish 15, mirror 16, brush 17, and shampoo bottle 18 accessories. A mermaid figurine (not shown) would also fit the environment and the accessories.

The seahorse figurine 11 has a relatively soft, hollow, upper portion 21 molded of vinyl or similar material forming a horse head 22 and chest 23. On the bottom 24 of the part 21 the outer surface is convex with a generally centrally disposed, inwardly projecting circular cylindrical walled bore 25. A mane 27 of synthetic hair is rooted to the head 22 in a manner conventional in the making of dolls and toy figurines. The mane hair is sufficiently long so that the lower strands extend down more than a third, but less than half, the overall height of the figurine. Since each bundle 28 of the rooted mane has a plurality of strands of synthetic hair material, the mane affords a child with numerous opportunities to comb, brush, wash and otherwise care for the seahorse figurine's mane. Particularly since the playset is intended for use in water such hair-care play is particularly attractive. In addition to facilitating the rooting of the hair, the soft hollow, upper portion 21 allows the child to squeeze the figurine and provides an enjoyable tactile sensation.

Figure 4:
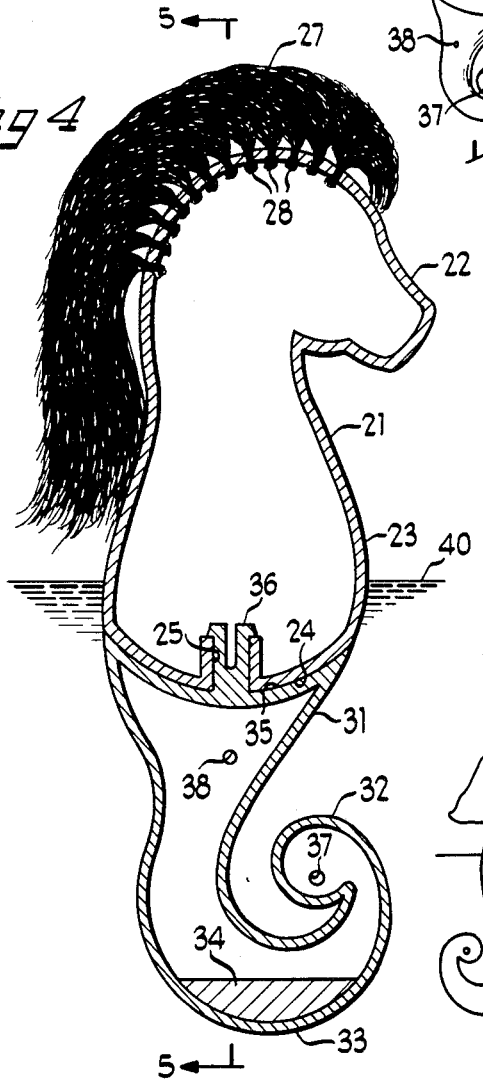
FIG. 4 is a further enlarged scale, sectional view taken generally along the line 4—4 of FIG. 3.

Lower "J" shaped tail portion 31 may be formed of a hard plastic material and is again hollow and conveniently moldable. The bottom end of the part 31 is formed in a conical coil or spiral to simulate a tail 32 with the lowest section 33 extending transverse to the vertical center of the figurine 11 in one direction and divided into unequal sections by the vertical center line. A weight 34 is secured in the section 33 so that the balance of the weight is offset from the vertical center line with more than half of the weight forward of the vertical center line as shown in FIG. 4. Outer top surface 35 of the part 31 is concave and mates with the convex surface 24 of the upper part 21. Approximately in the center of the concave surface there is a projecting split snap stud 36 that fits into, and is retained within, the bore 25 in a sufficiently tight relationship to effectively seal the interior of the part 21 against the entry of water. Stud 36 rotates in bore 25 connecting the upper portion 21 and lower portion 31 for relative rotation about an axis generally concentric with the vertical center line of the figurine.

Adjacent the tip of the tail 32 there is a pair of relatively small openings 37 and there are also similar size openings 38 proximate the top of the lower part 31. All of the openings 37 and 38 extend from the exterior into the interior of the part 31 to permit the displacement of air by water when the figurine 11 is put in the water, and to subsequently provide for drainage of the water. Although the weight 34 will tend to sink the tail 32 below the surface when the seahorse figurine 11 is placed in the water, the overall buoyancy of the figurine could prevent the seahorse from properly riding in the water. Accordingly, by admitting water into the hollow interior of the lower portion 31 displacing the air from that interior, the proper buoyancy will be achieved with all of part 31 submerged in the water. The figurine should float with the depending ends of the mane 27 above the water. While it is possible to instead increase the amount of the weight 34, the increase required for a toy figurine of a suitable size would be prohibitive both in cost and in the resulting overall weight of the figurine.

Figure 5:
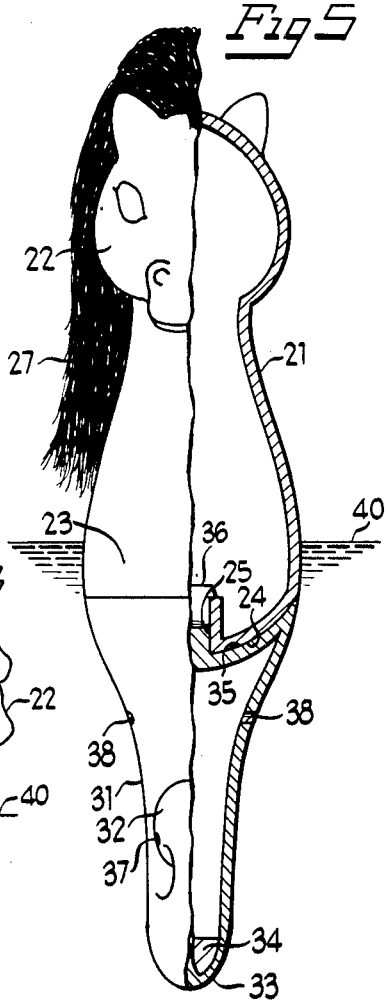
FIG. 5 is a fragmented, sectional view taken generally along the line 5—5 of FIG. 4.
Figure 6:
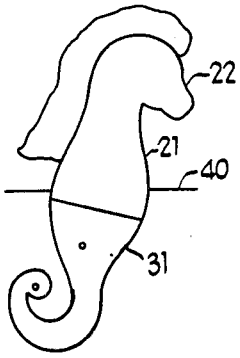
FIG. 6 is a schematic elevational view of the figurine.

When the figurine 11 is in the water with the coiled portion of the tail 32 facing forwardly, the figurine tends to ride in a substantially vertical orientation or perpendicular to the surface 40 of the water as illustrated in FIG. 1. However, when the lower portion 31 is rotated approximately 180 degrees, the balance of the weight 34 is shifted or rotated around the vertical outer line to the rear of the figurine. Thus, with the coil of the tail 32 to the rear of the figurine as in FIG. 6, the orientation will be canted such that the head 22 of the seahorse is brought closer to the surface 40. If the lower portion is rotated 90 degrees to one side or the other, the figurine will similarly be canted to the left or right of the vertical orientation illustrated in FIG. 5.

Coral corral 12 has an essentially horseshoe shaped enclosure 42 with three depending legs 43 for supporting the enclosure on a relatively flat surface such as a table. Projecting upwardly and outwardly from the main horseshoe portion 42 are plurality of branches 44 each having projecting limbs 45. Adjacent limbs 45, together with the underlying branch 44, are disposed so as to form holders or supports for various of the accessories such as the comb 14, brush 17, and shampoo bottle 18, all of which may be removed. The soap dish 15 is conveniently attached directly to the main portion 42 in a permanent manner and the mirror 16 is trapped between coral limbs 46 in a permanent mount. The corral 12 is constructed so that it floats in the water with a substantial portion of it above the surface and is buoyant enough to provide support for the accessories. When the playset is used out of the water with the legs 43 of the corral resting on the surface, some of the limbs such as 47 and 48 form generally "U" shaped stalls providing support for the seahorse figurine 11.

As when taking a bath, a child may float the corral 12 in the water and play with a seahorse figurine 11 "swimming" the figurine into and out of the horseshoe shaped corral, and may comb, brush, and wash the mane of the seahorse figurine. Out of the water, a child may similarly play with the set by supporting the seahorse figurine 11 within one of the "U" shaped stalls.

While a particular embodiment of the present invention has been shown and described, it will be apparent to those skilled in the art that changes and modifications may be made without departing from the true spirit and scope of the present invention. It is intended in the following claims to cover all such changes and modifications.

What is claimed as new and desired to be secured by Letters Patent is:

1. A toy figurine that floats in water having a vertical center line and comprising:

a hollow upper portion including a head with a section extending off center of the vertical center line;

a hollow lower "J" shaped portion with the bottom end forming a spiral tail section extending off center of the vertical center line;

means connecting said upper and lower portions to each other; and a rigid weight secured inside the spiral tail section with the balance of said weight offset from the vertical center line for submerging the lower portion in the water while substantially maintaining the head above the surface of the water without the need for any external weight.

2. The toy figurine of claim 1 in which said head section and tail sections extend in substantially opposed directions.

3. The toy figurine of claim 1 including means for supporting the figurine upon a relatively flat surface when the figurine is out of the water.

4. The toy figurine of claim 3 in which strands are rooted in the head and depend downwardly.

5. The toy figurine of claim 4 in which the strands depend down at least one-fifth the overall height of the figurine.

6. The toy figurine of claim 4 in which the strands depend down below the head and above the surface of the water when the figurine is placed in water.

7. The toy figurine of claim 1 in which strands are rooted in the head and depend downwardly.

8. The toy figurine of claim 7 in which the strands depend down at least one-fifth the overall height of the figurine.

9. The toy figurine of claim 7 in which the strands depend down below the head and above the surface of the water when the figurine is placed in water.

10. The toy figurine of claim 1 including a vent for admitting water to displace air from the figurine.

11. A playset including:

a figurine of a predetermined height that floats in water;

separable strands extending from the top of the figurine down at least one-fifth the height of the figurine;

a floating enclosure;

accessories for the care of the strands of the figurine;

means on the enclosure supporting the accessories at least partially above the surface of the water when the enclosure and accessories are placed in water;

means for supporting the enclosure upon a relatively flat surface when out of the water; and means on the enclosure to assist in the support of the figurine on the relatively flat surface.

12. The playset of claim 11 in which:

the figurine has an upper portion including a head and lower portion including a tail;

the upper and lower portions are connected such that the figurine floats in water with the entire tail portion submerged; and a substantial portion of the torso and the strands are above the surface of the water.

13. The playset of claim 12 in which the lower portion includes a weight in the tail.

14. The playset of claim 12 in which:

the upper and lower portions each have mating abutting surfaces; and one of the mating surfaces is generally concave and the other is generally convex.

15. The playset of claim 12 in which:

the upper and lower portions are connected for relative rotation; and the angular orientation of the figurine with respect to the surface of the water is controllable by rotation of the lower portion with respect to the upper portion.

16. A toy figurine having a vertical center line and comprising:

a hollow upper portion including a head;

a hollow lower "J" shaped portion with the bottom end forming a spiral tail;

means rotatably connecting the upper and the lower portions for relative rotation about the vertical center line; and a weight secured in the bottom end offset from the vertical center line for submerging the lower portion in water while maintaining the head above the surface of the water.

17. The toy figurine of claim 16 including means for supporting the figurine upon a relatively flat surface when the figurine is out of the water.

18. The toy figurine of claim 16 including:

separable strands extending from the head of the figurine;

accessories for the care of the strands of the figurine; and the support means providing support for the accessories at least partially above the surface of the water when the support means is placed in the water.

19. The toy figurine of claim 16 in which strands are rooted in the head and depend downwardly.

20. The toy figurine of claim 19 in which the strands depend down at least one-fifth the overall height of the figurine.

* * * * *